US011293726B2

(12) United States Patent
Biafore, Jr.

(10) Patent No.: US 11,293,726 B2
(45) Date of Patent: Apr. 5, 2022

(54) BALLISTIC BARREL CLEANING CARTRIDGE

(71) Applicant: Midwest Outdoor Holdings LLC, Commerce Township, MI (US)

(72) Inventor: John Biafore, Jr., Grand Blanc, MI (US)

(73) Assignee: Midwest Outdoor Holdings, LLC, Commerce Township, MI (US)

( * ) Notice: Subject to any disclaimer, the term of this patent is extended or adjusted under 35 U.S.C. 154(b) by 0 days.

(21) Appl. No.: 17/118,495

(22) Filed: Dec. 10, 2020

(65) Prior Publication Data

US 2021/0180924 A1 Jun. 17, 2021

Related U.S. Application Data

(60) Provisional application No. 62/946,693, filed on Dec. 11, 2019.

(51) Int. Cl.
*F42B 5/24* (2006.01)

(52) U.S. Cl.
CPC ..... *F42B 5/24* (2013.01)

(58) Field of Classification Search
CPC ..... F41A 5/24; F41A 29/04
USPC ..... 102/442, 529
See application file for complete search history.

(56) References Cited

U.S. PATENT DOCUMENTS 1,231,227 A * 6/1917 Williams ..... F42B 5/24 102/442
2,047,897 A * 7/1936 Symes ..... F42B 5/24 102/442
2,442,155 A * 5/1948 Weese ..... F42B 5/24 102/529
2,765,740 A * 10/1956 Norman ..... F42B 5/24 102/442
2,995,090 A * 8/1961 Daubenspeck ..... F42B 12/745 102/529
3,476,047 A * 11/1969 Davis ..... F42B 5/24 102/442
3,740,883 A * 6/1973 Kyle ..... F42B 5/24 42/95

(Continued)

FOREIGN PATENT DOCUMENTS

GB 2061148 A * 5/1981 ..... B24C 11/00
GB 2061148 A 5/1981
WO 2004040230 A1 5/2004

OTHER PUBLICATIONS

International search report for the international application No. PCT/US 20/64370.

*Primary Examiner* — Derrick R Morgan
(74) *Attorney, Agent, or Firm* — Quinn IP Law

(57) ABSTRACT

An apparatus including a ballistic barrel cleaning cartridge is provided. The apparatus includes a casing including a casing recess. The casing recess is closed at a first end of the casing. The apparatus further includes a propellant disposed within the casing recess and an abrasive-binding agent composite slug constructed with an abrasive agent and a polymerized binding agent. The abrasive-binding agent composite slug is disposed within the casing recess at a second end of the casing. Expansion of the propellant is operable to expel the abrasive-binding agent composite slug from the casing recess and propel the abrasive-binding agent composite slug down a bore of a firearm.

18 Claims, 9 Drawing Sheets

(56) References Cited

U.S. PATENT DOCUMENTS 3,898,933 A * 8/1975 Castera ..... F42B 8/16 102/529
4,513,668 A * 4/1985 Fuller ..... F42B 5/24 102/511
4,998,368 A * 3/1991 Blase ..... F42B 5/24 102/442
5,214,237 A * 5/1993 McArthur ..... F42B 12/34 102/501
5,233,128 A * 8/1993 Lai ..... F42B 5/24 102/511
5,237,930 A * 8/1993 Belanger ..... C22C 32/0094 102/529
5,341,744 A * 8/1994 Shi ..... F42B 5/24 102/430
5,777,258 A * 7/1998 Soon ..... F42B 5/24 102/442
6,389,978 B1 * 5/2002 Hooper ..... F42B 5/24 102/440
7,131,381 B1 * 11/2006 Nafziger ..... F42B 5/24 102/444
7,451,707 B1 * 11/2008 Hadden ..... F41A 29/02 102/442
7,743,706 B1 6/2010 Lai
8,850,737 B1 * 10/2014 Rogers ..... F41A 29/02 42/90
9,175,939 B1 * 11/2015 Wilfong ..... F42B 5/26
9,212,879 B2 * 12/2015 Whitworth ..... F42B 7/08
9,664,487 B2 * 5/2017 Whitworth ..... F42B 14/00
10,012,466 B2 * 7/2018 Whitworth ..... F41A 29/02
10,018,455 B2 * 7/2018 Whitworth ..... F42B 5/24
10,578,408 B2 * 3/2020 Whitworth ..... F42B 7/00
10,684,103 B2 * 6/2020 Whitworth ..... F42B 5/24
2012/0124883 A1 * 5/2012 Reggio ..... B08B 9/00 42/95
2012/0132549 A1 * 5/2012 Dewey ..... B08B 9/00 206/223
2014/0331886 A1 11/2014 Whitworth
2015/0268021 A1 * 9/2015 Whitworth ..... F42B 14/00 102/529
2016/0161232 A1 6/2016 Rubin
2018/0283833 A1 10/2018 Mackenzie et al.
2020/0278170 A1 * 9/2020 Peterson ..... F41C 9/08

* cited by examiner

BALLISTIC BARREL CLEANING CARTRIDGE

CROSS-REFERENCE TO RELATED APPLICATIONS

This disclosure claims priority to Provisional Patent Application No. 62/946,693 filed on Dec. 11, 2019, which is hereby incorporated by reference.

TECHNICAL FIELD

This disclosure relates to a ballistic barrel cleaning cartridge, and, more particularly, to a disposable ballistic barrel cleaning cartridge which cleans a bore of a barrel of a firearm when fired.

BACKGROUND

The statements in this section merely provide background information related to the present disclosure. Accordingly, such statements are not intended to constitute an admission of prior art.

Shotguns, long guns, handguns, and other firearms are well known tools and recreational instruments. Best practice includes cleaning firearm and ballistic barrels regularly in order to keep the gun in the best condition possible for accurate shooting. One of the main components of a firearm that may be cleaned is a bore of the barrel. In fact, the bore may be cleaned after each use; which may be a bothersome and time-consuming task. Because of this, firearm owners may not clean their firearm bores.

SUMMARY

An apparatus including a ballistic barrel cleaning cartridge is provided. The apparatus includes a casing including a casing recess. The casing recess is closed at a first end of the casing. The apparatus further includes a propellant disposed within the casing recess and an abrasive-binding agent composite slug constructed with an abrasive agent and a polymerized binding agent. The abrasive-binding agent composite slug is disposed within the casing recess at a second end of the casing. Expansion of the propellant is operable to expel the abrasive-binding agent composite slug from the casing recess and propel the abrasive-binding agent composite slug down a bore of a firearm.

In some embodiments, the abrasive agent includes fiberglass.

In some embodiments, the abrasive agent includes glass.

In some embodiments, the polymerized binding agent includes nylon.

In some embodiments, the polymerized binding agent includes one of acrylonitrile butadiene styrene, polypropylene, and polyethylene.

In some embodiments, the apparatus further includes a high-density weight. The high-density weight includes a per unit volume greater than a mass per unit volume of the abrasive-binding agent composite slug.

In some embodiments, the high-density weight is exposed at a front portion of the ballistic barrel cleaning cartridge.

In some embodiments, the high-density weight is encased within the abrasive-binding agent composite slug.

In some embodiments, the abrasive-binding agent composite slug includes a conical recess. In some embodiments, the high-density weight is initially disposed at a wide portion of the conical recess.

In some embodiments, the abrasive-binding agent composite slug includes a bore rearward recess. In some embodiments, the high-density weight includes a high-density insert inserted within the bore rearward recess.

In some embodiments, the bore rearward recess includes one or more elongated inner grooves running parallel to a longitudinal axis of the abrasive-binding agent composite slug.

In some embodiments, a rear portion of the abrasive-binding agent composite slug is concave.

In some embodiments, the abrasive agent is interspersed within the polymerized binding agent.

In some embodiments, the casing recess is cylindrically shaped, and the abrasive-binding agent composite slug is cylindrically shaped.

In some embodiments, the casing recess includes an octagonal cross-sectional shape, and the abrasive-binding agent composite slug includes an octagonal cross-sectional shape.

According to one alternative embodiment, an apparatus including a ballistic barrel cleaning cartridge is provided. The apparatus includes a casing including a cylindrical casing recess. The cylindrical casing recess is closed at a first end of the casing. The apparatus further includes a propellant disposed within the cylindrical casing recess and a two-piece slug assembly. The two-piece slug assembly includes an abrasive-binding agent composite slug constructed with an abrasive agent and a polymerized binding agent, and further includes a bore rearward recess. The two-piece slug assembly further includes a cylindrical high-density insert inserted within the bore rearward recess. The two-piece slug assembly is disposed within the cylindrical casing recess at a second end of the casing. Expansion of the propellant is operable to expel the abrasive-binding agent composite slug from the cylindrical casing recess and propel the abrasive-binding agent composite slug down a bore of a firearm.

In some embodiments, the abrasive agent includes fiberglass.

In some embodiments, the abrasive agent includes glass.

In some embodiments, the polymerized binding agent includes nylon.

In some embodiments, the abrasive agent is interspersed within the polymerized binding agent.

BRIEF DESCRIPTION OF THE DRAWINGS

One or more embodiments will now be described, by way of example, with reference to the accompanying drawings, in which.

DETAILED DESCRIPTION

Figure 2:
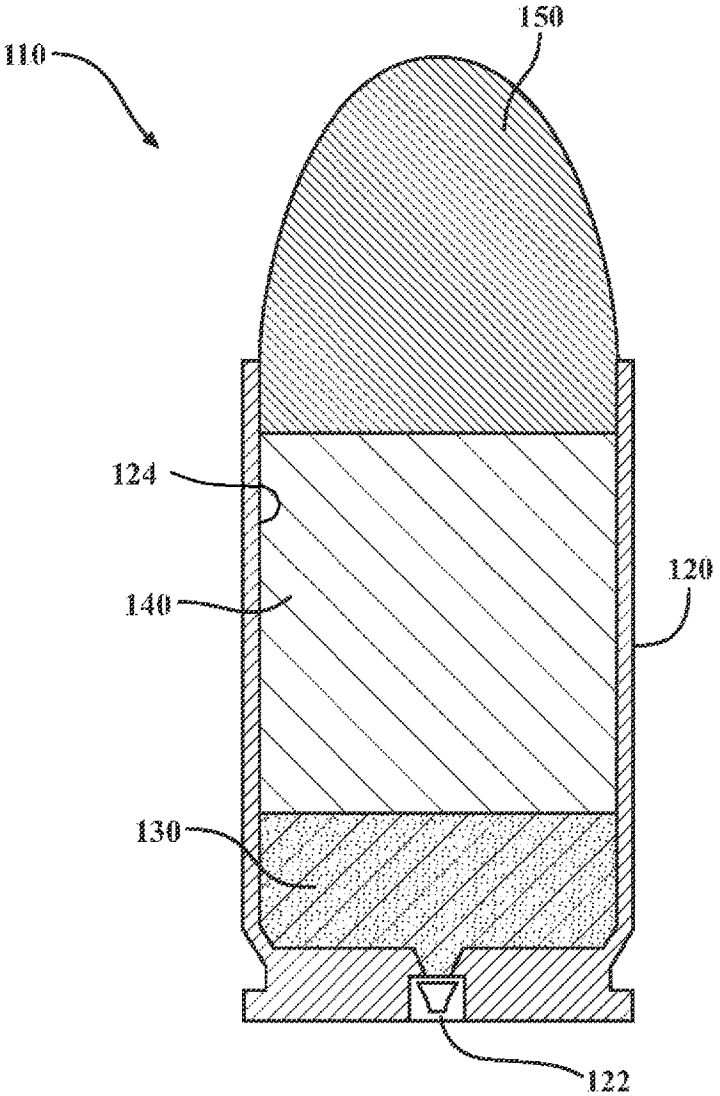
FIG. 2 schematically illustrates in cross sectional view a second exemplary embodiment of a ballistic barrel cleaning cartridge, including a high-density weight including a bullet portion, in accordance with the present disclosure.

Reference throughout this specification to "one embodiment," "an embodiment," or similar language means that a particular feature, structure, or characteristic described in connection with the embodiment is included in at least one embodiment of the subject matter of the present disclosure. Appearances of the phrases "in one embodiment," "in an embodiment," and similar language throughout this specification may, but do not necessarily, refer to the same embodiment.

As used in the description herein and throughout the claims, the following terms take the meanings explicitly associated herein, unless the context clearly dictates otherwise: the meaning of "a," "an," and "the" includes plural reference, the meaning of "in" includes "in" and "on." The term "based upon" is not exclusive and allows for being based on additional factors not described, unless the context clearly dictates otherwise. Additionally, in the subject description, the word "exemplary" is used to mean serving as an example, instance or illustration. Any embodiment or design described herein as "exemplary" is not necessarily to be construed as preferred or advantageous over other embodiments or designs. Rather, use of the word exemplary is intended to present concepts in a concrete manner.

Various embodiments of the present disclosure will be described in detail with reference to the drawings, where like reference numerals represent like parts and assemblies throughout the several views. Reference to various embodiments does not limit the scope of the disclosure. Additionally, any examples set forth in this specification are not intended to be limiting and merely set forth some of the many possible embodiments for the claimed disclosure.

In many ballistic barrels of a firearm, a cartridge or casing is loaded directly into a breach portion of a bore of the barrel. Firing rounds leaves residue and debris on the bore surface. This residue and debris may build up through extended and repeated use without appropriate cleaning. When cleaning, a ballistic barrel cleaning cartridge may be loaded into the bore. A user may then actuate a trigger on the firearm to fire the ballistic barrel cleaning cartridge. The firing of the cleaning cartridge or bullet allows a cleaning projectile including cleaning material to be moved through the bore in a compressed state, as will be discussed in more detail below.

A ballistic bore cleaning cartridge is provided which includes a composite slug or a slug having two or more materials in the slug. According to one embodiment, an abrasive or scrubbing agent is mixed with and held in place by a binding agent. Various abrasive-binding agent composite slugs are envisioned. In one embodiment, a glass filled polymer is one example of an abrasive-binding agent composite slug that may be used in a ballistic bore cleaning cartridge. In one non-limiting example, a 30% glass/70% nylon material may be used to create an abrasive-binding agent composite slug. In another embodiment, a brass shaving filled polymer, such as acrylonitrile butadiene styrene (ABS), polypropylene, or polyethylene, is another example of an abrasive-binding agent composite slug that may be used in a ballistic bore cleaning cartridge. In another embodiment, a glass filled cork material is another example of an abrasive-binding agent composite slug that may be used in a ballistic bore cleaning cartridge.

Materials may be used for the abrasive agent that are softer than steel used to construct ballistic barrels. Softer materials will not scratch or significantly wear the steel material of the bore.

Materials in the abrasive-binding agent composite slug may be uniformly mixed and distributed within the abrasive-binding agent composite slug. In one embodiment, two or more parts may be formed or secured together to provide advantageous properties to the slug. For example, a high-density or metallic weight may be inset within an injection molded slug, with the metallic weight providing back pressure within the bore as the slug is propelled down the bore, with the injection molded material around the inset metallic weight including an exemplary glass filled polymer. In one exemplary embodiment, a portion of the abrasive-binding agent composite slug may form a bore forward cup in which metallic pellets, a metallic paste, or other dense material may be loaded for the purpose of providing back pressure upon the slug as the slug is propelled down the bore.

The disclosed device includes a formulation of components designed to optimize cleaning and improve an ability to load the device into a chamber of a firearm. The device may readily be modified to accommodate multiple cartridge configurations, calibers, firearm types, etc.

Figure 1:
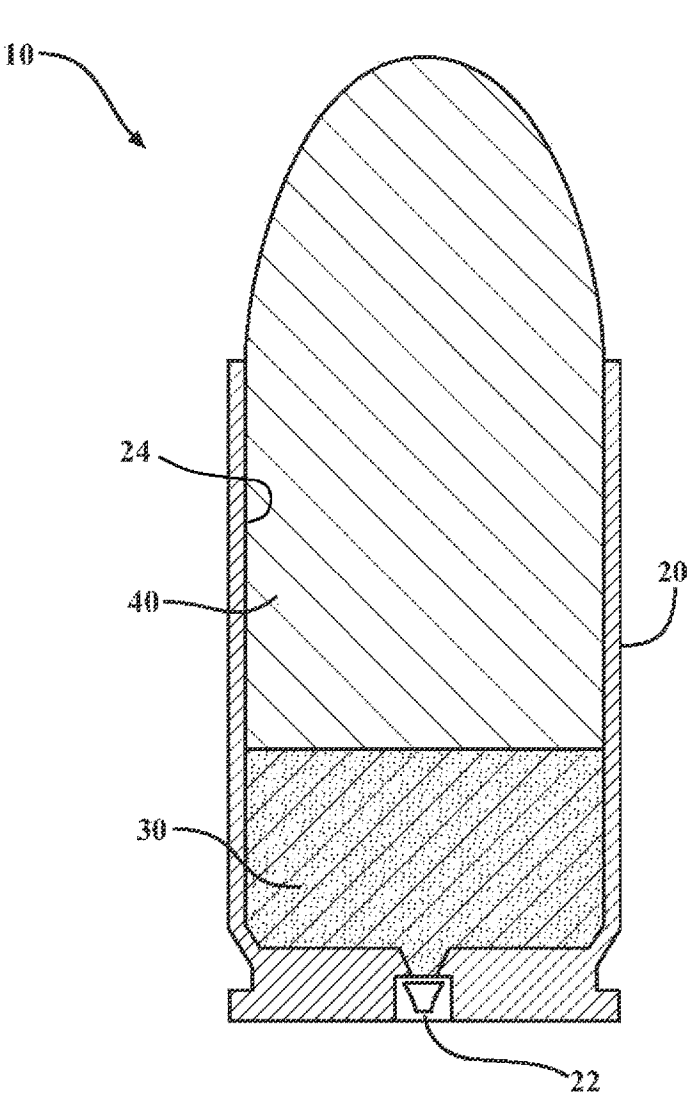
FIG. 1 schematically illustrates in cross sectional view a first exemplary embodiment of a ballistic barrel cleaning cartridge operable to be used in an exemplary firearm, in accordance with the present disclosure.

Referring now to the drawings, wherein the showings are for the purpose of illustrating certain exemplary embodiments and not for the purpose of limiting the same, FIG. 1 schematically illustrates in cross sectional view a first exemplary embodiment of a ballistic barrel cleaning cartridge configured for use in an exemplary firearm such as a pistol or a rifle. A ballistic barrel cleaning cartridge 10 is illustrated, including casing 20, propellant 30, and abrasive-binding agent composite slug 40. Casing 20 may be made of brass, steel, or any other material known in the art for ammunition casings. Casing 20 includes a casing recess 24 which is cylindrically shaped. The casing recess 24 may be described as an open end of the casing 20, a walled-in enclosure with an open end, or a concave region of the casing 20. Casing 20 may include a primer 22 operable to create a spark when struck by a firing pin of a firearm. Casing 20 may be a centerfire casing or, alternatively, a rimfire casing. The abrasive-binding agent composite slug 40 is illustrated within the casing recess 24 of the casing 20 and may include an abrasive agent, for example, including glass or fiberglass particles. The propellant 30 is also illustrated within the casing recess 24. The abrasive-binding agent composite slug 40 may additionally include a polymerized binding agent. The abrasive agent may be interspersed within the binding agent. The abrasive agent is operable to clean or scrub an inside of a bore of a firearm when propelled down the bore, the exemplary glass or fiberglass particles scraping along the bore and dislodging contaminant particles therefrom.

Propellant 30 may include chemical compositions available in the art configured to rapidly or explosively expand as a spark is introduced and may include, in one non-limiting embodiment, gunpowder.

Abrasive-binding agent composite slug 40 is illustrated including a single piece slug configured to imitate an overall shape of a bullet. A proportion of the size of abrasive-binding agent composite slug 40 to propellant 30 (i.e. how much of the volume of casing 20 is taken up by the propellant vs. the slug) is variable depending upon selectable properties of the slug and the propellant, and the proportions of abrasive-binding agent composite slug 40 and propellant 30 are provided as examples. As abrasive-binding agent composite slug 40 is propelled down the bore of a firearm, it becomes a cleaning projectile.

FIG. 2 schematically illustrates in cross sectional view a second exemplary embodiment of a ballistic barrel cleaning cartridge, including a high-density bullet portion. Ballistic barrel cleaning cartridge 110 is illustrated, including casing 120, primer 122, propellant 130, abrasive-binding agent composite slug 140, and an exemplary high-density weight embodied as bullet 150. The abrasive-binding agent composite slug 140 is illustrated within a cylindrical casing recess 124 of the casing 120. Propellant 130 is also illustrated with the cylindrical casing recess 124 of the casing 120. A high-density weight or insert may be defined as including a mass per unit volume greater than a mass per unit volume of the abrasive-binding agent composite slug. Ballistic barrel cleaning cartridge 110 is similar to ballistic barrel cleaning cartridge 10 with the exception that bullet 150 provides back pressure within the bore of the firearm. Whereas abrasive-binding agent composite slug 40 of FIG. 1 may be relatively lightweight or low mass, a high-density weight or metallic bullet such as bullet 150 is relatively higher mass, so the expanding gas created by igniting propellant 130 takes longer to accelerate bullet 150 and abrasive-binding agent composite slug 140 down the bore of the firearm than just abrasive-binding agent composite slug 40 by itself. Back pressure within the bore acting upon abrasive-binding agent composite slug 140 can, in some embodiments, be useful, for example, to cause abrasive-binding agent composite slug 140 to deform, expand, or otherwise to press outwardly against the bore when propelled through the barrel.

Figure 3:
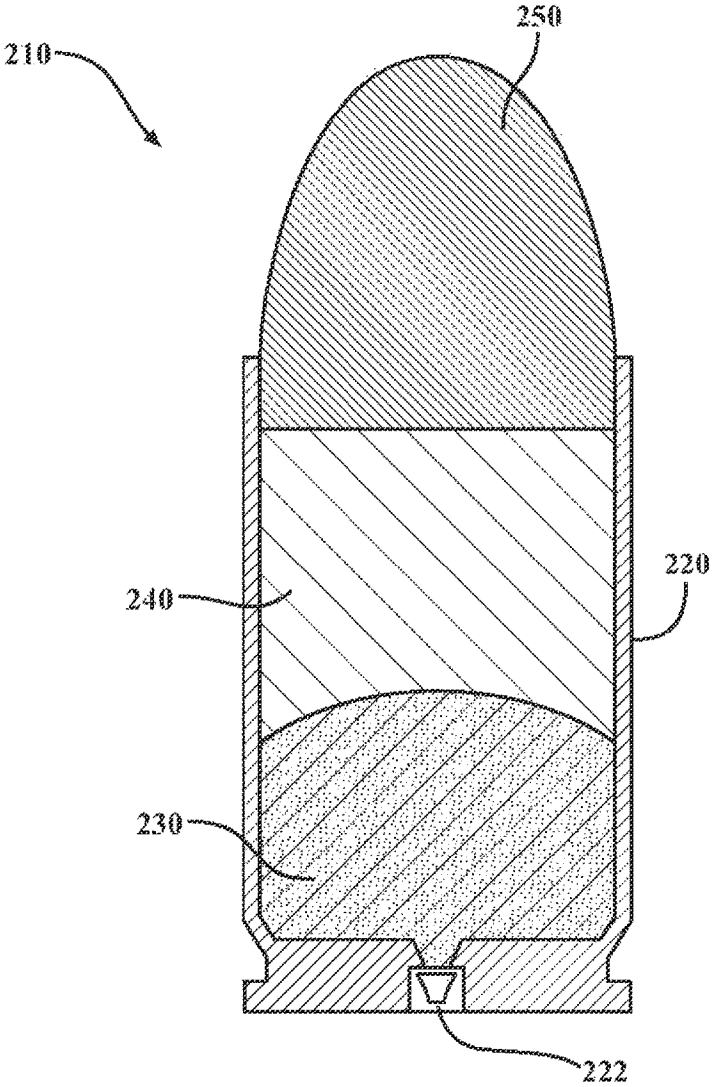
FIG. 3 schematically illustrates in cross sectional view a third exemplary embodiment of a ballistic barrel cleaning cartridge, including a bullet portion and an abrasive-binding agent composite slug including a gas seal portion, in accordance with the present disclosure.

FIG. 3 schematically illustrates in cross sectional view a third exemplary embodiment of a ballistic barrel cleaning cartridge, including a bullet portion and an abrasive-binding agent composite slug including a gas seal portion. Ballistic barrel cleaning cartridge 210 is illustrated, including casing 220, primer 222, propellant 230, abrasive-binding agent composite slug 240, and a high-density weight embodied as bullet 250. Ballistic barrel cleaning cartridge 210 is similar to ballistic barrel cleaning cartridge 110 of FIG. 2, with an exception that a bottom surface of abrasive-binding agent composite slug 240 is concave. This concavity enables abrasive-binding agent composite slug 240 to deform outwardly against the bore and seal the expanding gases of the propellant 230 from escaping past the abrasive-binding agent composite slug 240. This outward deformation additionally adds to the wiping capacity of the cleaning projectile.

Figure 4:
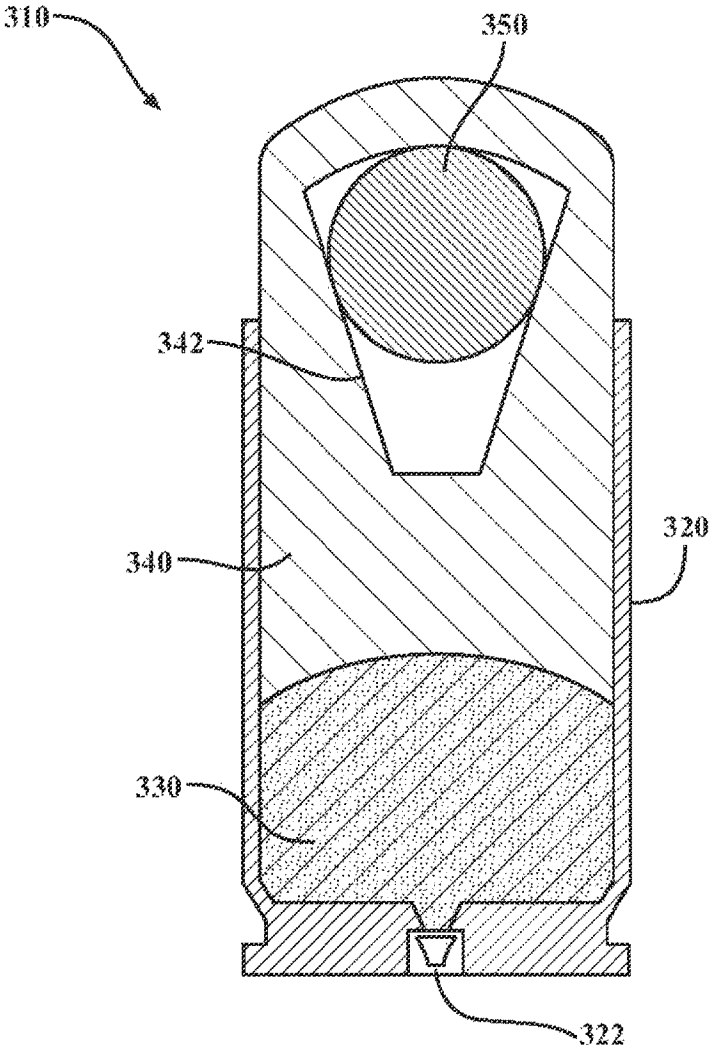
FIG. 4 schematically illustrates in cross sectional view a fourth exemplary embodiment of a ballistic barrel cleaning cartridge, including an abrasive-binding agent composite slug including a molded-in metallic weight and a bore forward conical recess, in accordance with the present disclosure.

FIG. 4 schematically illustrates in cross sectional view a fourth exemplary embodiment of a ballistic barrel cleaning cartridge, including an abrasive-binding agent composite slug including a molded-in high-density weight or metallic weight and a bore forward conical recess. Ballistic barrel cleaning cartridge 310 is illustrated, including casing 320, primer 322, propellant 330, abrasive-binding agent composite slug 340, and molded-in metallic weight 350. Abrasive-binding agent composite slug 340 includes a bore forward conical recess 342. Metallic weight 350 is initially positioned at a top/widest portion of the conical recess 342. As abrasive-binding agent composite slug 340 is propelled down the bore, a force of inertia on metallic weight 350 will cause metallic weight 350 to move bore rearward in comparison to abrasive-binding agent composite slug 340, such that metallic weight 350 will be wedged down into the narrower portion of conical recess 342. This wedging of metallic weight 350 into conical recess 342 will force the walls of abrasive-binding agent composite slug 340 outward radially against the bore.

Metallic weight 350 will similarly cause increased back pressure within the bore as compared to abrasive-binding agent composite slug 340 if no metallic weight 350 were present. Metallic weight 350 is exemplary. Metallic weight 350 may be replaced by a small stone, a ceramic ball, or any other similar shaped object with relatively higher density than abrasive-binding agent composite slug 340.

Figure 5:
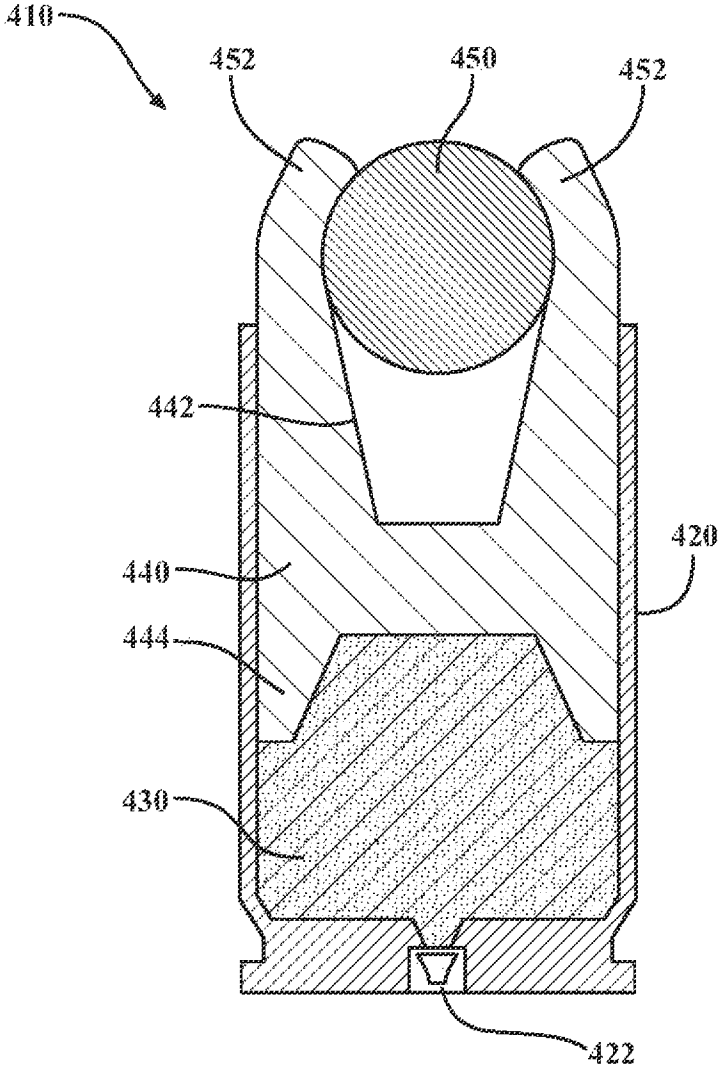
FIG. 5 schematically illustrates in cross sectional view a fifth exemplary embodiment of a ballistic barrel cleaning cartridge, including a bore forward metallic weight and an abrasive-binding agent composite slug including a bore forward conical recess and partial encapsulation of the bore forward metallic weight, in accordance with the present disclosure.

FIG. 5 schematically illustrates in cross sectional view a fifth exemplary embodiment of a ballistic barrel cleaning cartridge, including a bore forward metallic weight and an abrasive-binding agent composite slug including a bore forward conical recess and partial encapsulation of the bore forward metallic weight. Ballistic barrel cleaning cartridge 410 is illustrated, including casing 420, primer 422, propellant 430, abrasive-binding agent composite slug 440, and bore forward metallic weight 450. Abrasive-binding agent composite slug 440 includes bore forward conical recess 442. Ballistic bore cleaning cartridge 410 is similar to ballistic bore cleaning cartridge 310 of FIG. 4, with an exception that bore forward metallic weight 450 is partially encapsulated by front portion 452 of abrasive-binding agent composite slug 440. In one embodiment, during initial assembly, bore forward metallic weight may be snappingly pressed within front portion 452 through the open front end of abrasive-binding agent composite slug 440. Rear portion 444 of abrasive-binding agent composite slug 440 includes a sharp-edge form gas seal.

Figure 6:
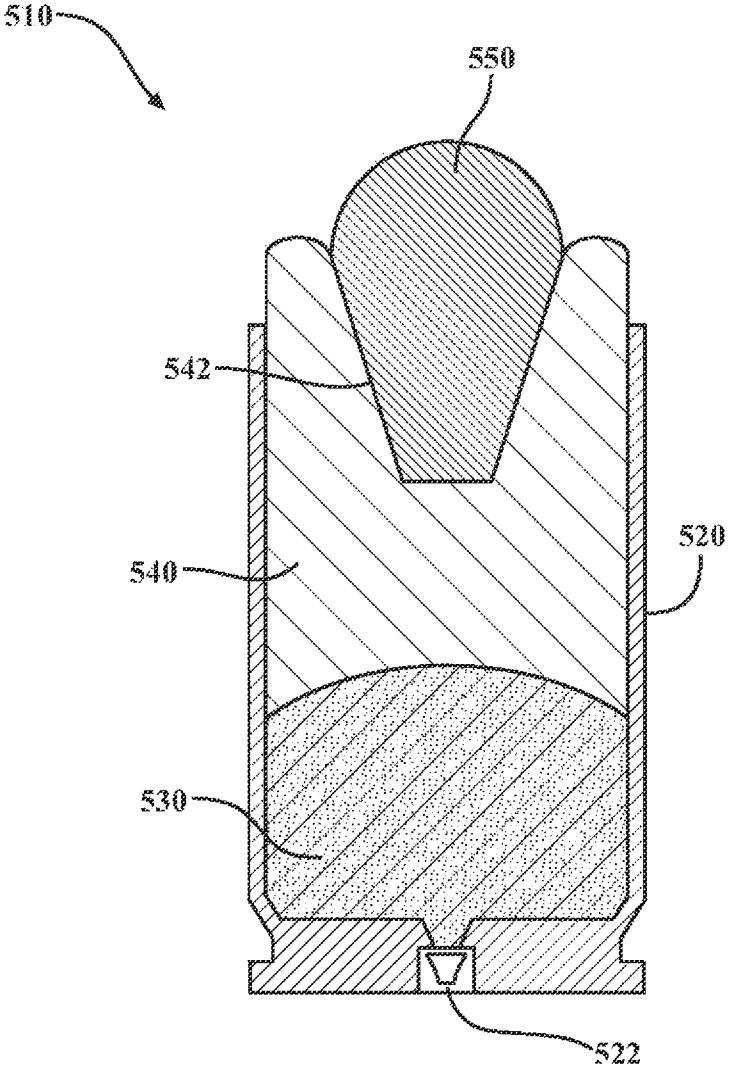
FIG. 6 schematically illustrates in cross sectional view a sixth exemplary embodiment of a ballistic barrel cleaning cartridge, including an alternative embodiment of a bore forward metallic weight and an abrasive-binding agent composite slug including a bore forward conical recess, in accordance with the present disclosure.

FIG. 6 schematically illustrates in cross sectional view a sixth exemplary embodiment of a ballistic barrel cleaning cartridge, including an alternative embodiment of a bore forward metallic weight and an abrasive-binding agent composite slug including a bore forward conical recess. Ballistic barrel cleaning cartridge 510 is illustrated, including casing 520, primer 522, propellant 530, abrasive-binding agent composite slug 540, and bore forward metallic weight 550. Abrasive-binding agent composite slug 540 includes bore forward conical recess 542. Ballistic bore cleaning cartridge 510 is similar to ballistic bore cleaning cartridge 410 of FIG. 5, with an exception that bore forward metallic weight 550 does not include a notch, and, therefore, it is relatively easier for metallic weight 550 to be wedged down within a narrower portion of bore forward conical recess 542.

Figure 8:
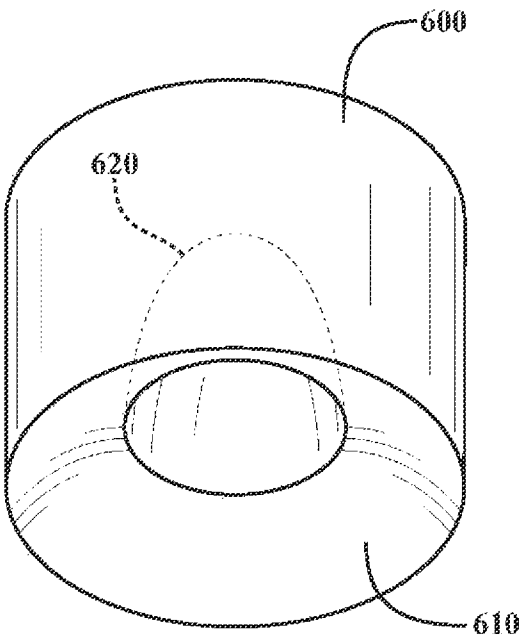
FIG. 8 illustrates in bottom perspective view the abrasive-binding agent composite slug of FIG. 7, in accordance with the present disclosure.
Figure 7:
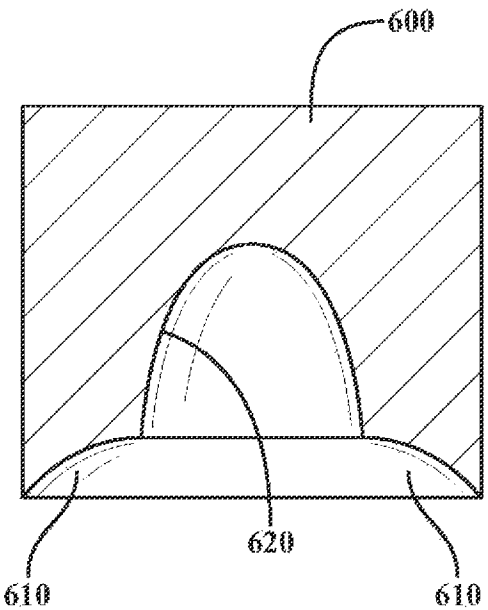
FIG. 7 schematically illustrates in cross sectional view an alternative embodiment of an abrasive-binding agent composite slug, in accordance with the present disclosure.

FIG. 7 schematically illustrates in cross sectional view an alternative embodiment of an abrasive-binding agent composite slug. Abrasive-binding agent composite slug 600 is illustrated, including an annular ring depression 610 operable to enable abrasive-binding agent composite slug 600 to act as a gas seal. Further, abrasive-binding agent composite slug 600 includes a hollow bottom portion 620. Expanding gas from a propellant pressing against and within hollow bottom portion 620 causes the side walls of abrasive-binding agent composite slug 600 to deform and press outwardly against the bore. FIG. 8 illustrates in bottom perspective view the abrasive-binding agent composite slug of FIG. 7. Abrasive-binding agent composite slug 600 is illustrated including annular ring depression 610 and hollow bottom portion 620.

Figure 9:
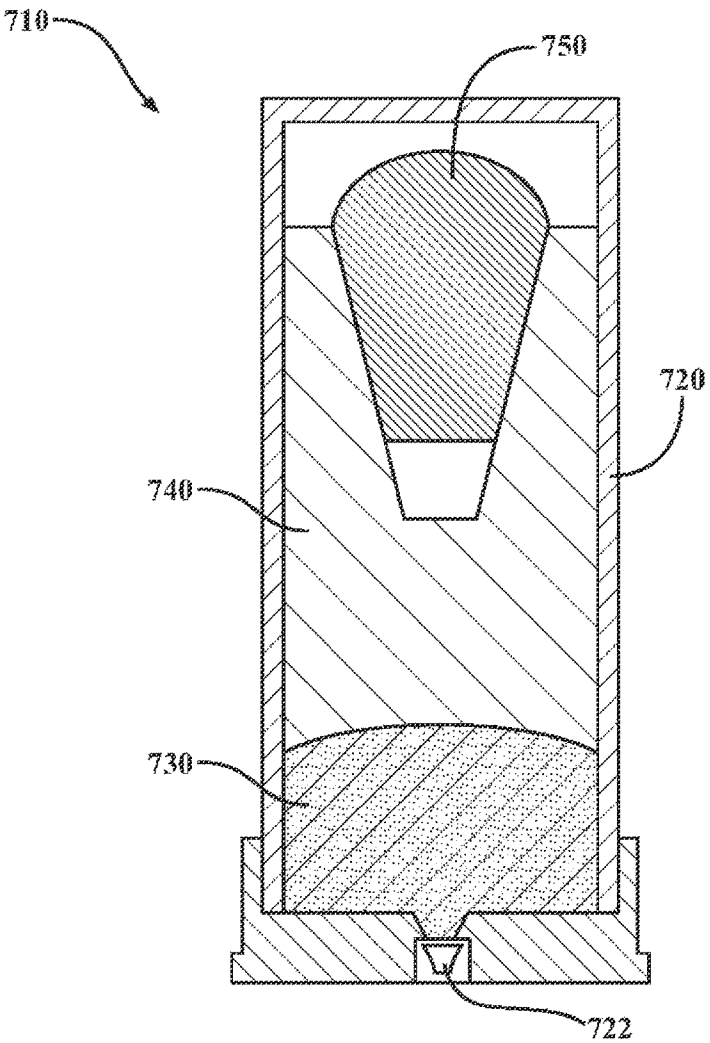
FIG. 9 schematically illustrates in cross sectional view an exemplary embodiment of a ballistic barrel cleaning cartridge operable to be used in an exemplary smooth-bore device, in accordance with the present disclosure.

FIG. 9 schematically illustrates in cross sectional view an exemplary embodiment of a ballistic barrel cleaning cartridge configured for use in an exemplary smooth-bore device such as a shotgun. Ballistic barrel cleaning cartridge 710 is illustrated, including casing 720, primer 722, propellant 730, abrasive-binding agent composite slug 740, and bore forward weight 750. Abrasive-binding agent composite slug 740 may be modified to include any features of other slugs described herein, for example, including features of slugs in FIG. 3, 4, 5, or 6.

Figure 10:
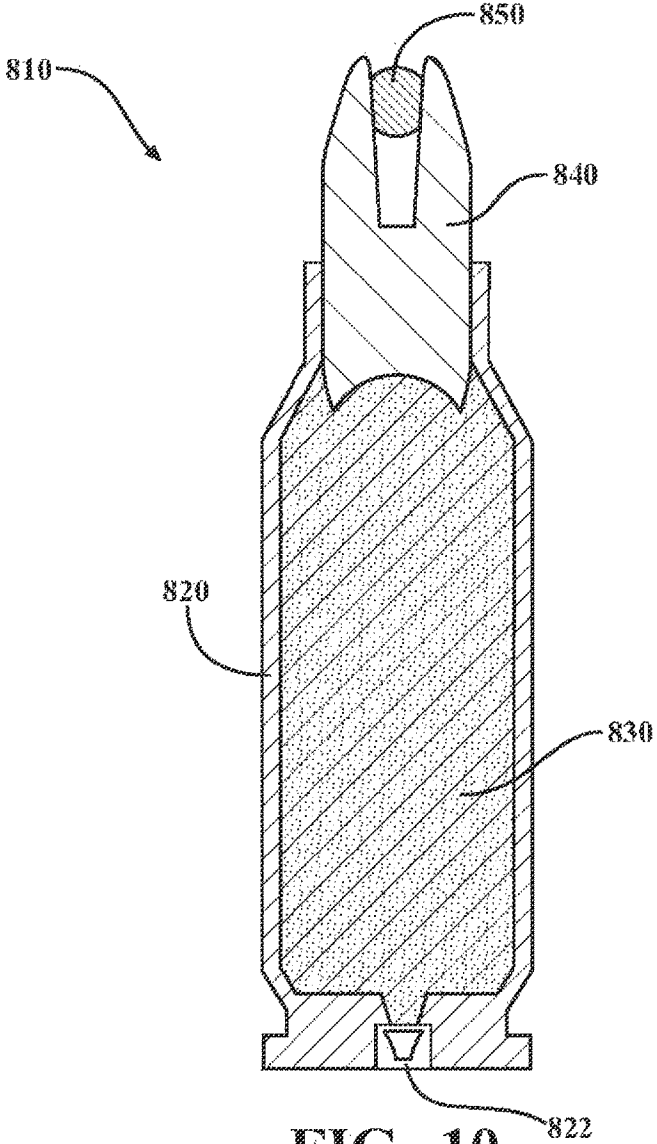
FIG. 10 schematically illustrates in cross sectional view an exemplary embodiment of a ballistic barrel cleaning cartridge embodied as a cartridge including a bottleneck casing operable to be used in an exemplary firearm, in accordance with the present disclosure.

FIG. 10 schematically illustrates in cross sectional view an exemplary embodiment of a ballistic barrel cleaning cartridge embodied as a cartridge including a bottleneck casing configured for use in an exemplary firearm. Ballistic barrel cleaning cartridge 810 is illustrated, including casing 820, primer 822, propellant 830, abrasive-binding agent composite slug 840, and bore forward weight 850.

Figure 11:
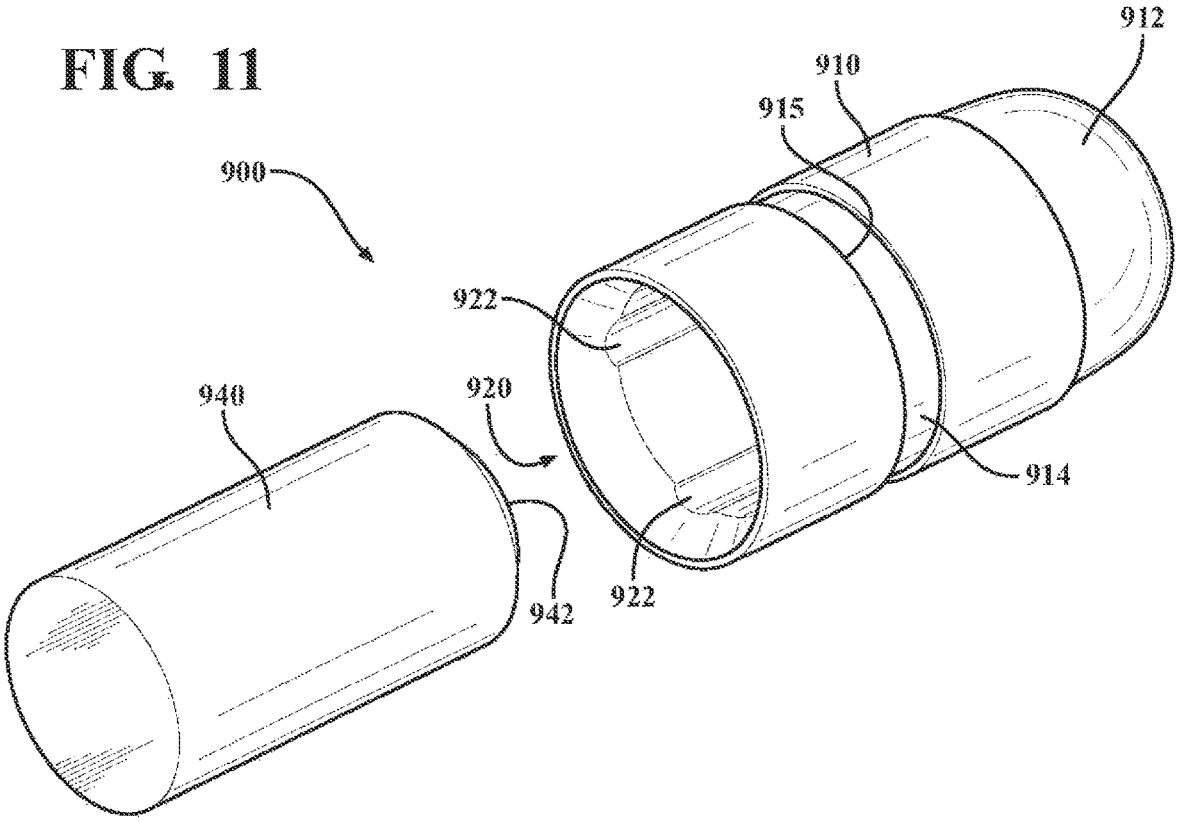
FIG. 11 schematically illustrates an exemplary alternative embodiment of an abrasive-binding agent composite slug including a bore rearward recess and a high-density insert operable to be inserted within the bore rearward recess, in accordance with the present disclosure.

FIG. 11 schematically illustrates an exemplary alternative embodiment of an abrasive-binding agent composite slug including a bore rearward recess. A two-piece slug assembly 900 is illustrated in a disassembled state, with a cylindrical high-density insert 940 outside of a bore rearward recess 920 of an abrasive-binding agent composite slug 910. While the high-density insert 940 of FIG. 11 is illustrated in a generally cylindrical shape, it will be appreciated that other non-cylindrical shapes may be utilized. The high-density insert 940 may be metallic, for example, constructed with lead, copper, zinc, steel, or other similar metals, or the high-density insert 940 may be constructed with stone, glass, a polymer, or other similar materials. The abrasive-binding agent composite slug 910 includes a tapered bore forward tip 912, an annular depressed groove 914 disposed about a mid-outer portion of the abrasive-binding agent composite slug 910, and the bore rearward recess 920. The abrasive-binding agent composite slug 910 may include a cylindrical portion configured to fit within a bore of a firearm. The bore rearward recess 920 may include one or more elongated inner grooves 922 running parallel to a longitudinal axis of the abrasive-binding agent composite slug 910. The inner grooves 922 may be useful as an assembly aid, providing for ease of inserting and removing a high-density insert to and from the bore rearward recess 920. In another embodiment, the inner grooves 922 may be omitted. The annular depressed groove 914 may additionally provide an edge 915 which is operable to increase scrubbing action upon the inner surface of the bore. The abrasive-binding agent composite slug 910 may include a binding agent such as a plastic or a polymer. The abrasive-binding agent composite slug 910 may further include an abrasive agent such as glass or fiberglass dispersed throughout the binding agent as a homogeneous or semi-homogeneous mixture.

The high-density insert 940 may include a tapered tip 942. The high-density insert 940 may be fully inserted within the bore rearward recess 920 to form the abrasive-binding agent composite slug 910. The abrasive-binding agent composite slug 910 may be fit within a brass casing pre-loaded with a propellant, similar to the device of FIG. 1.

Figure 12:
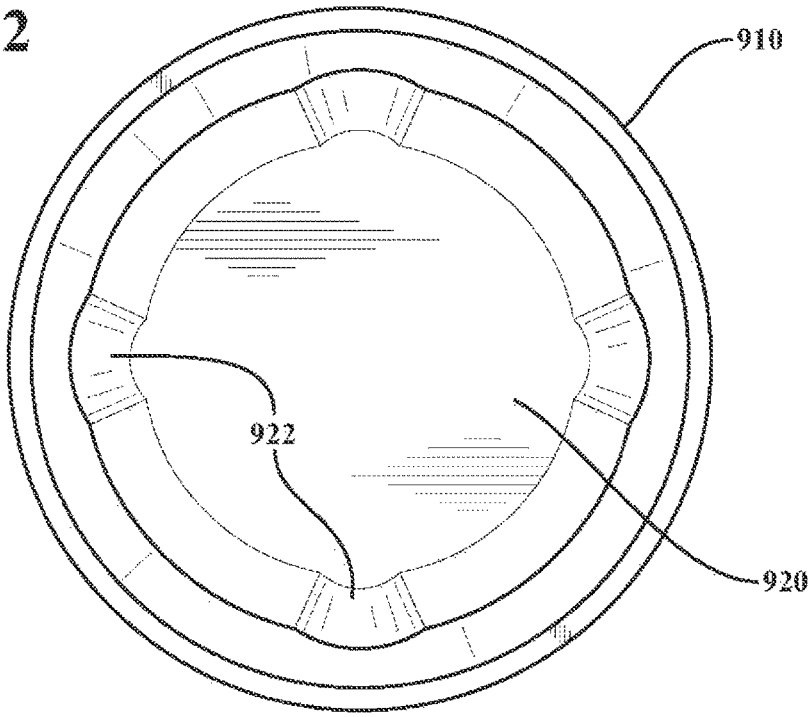
FIG. 12 schematically illustrates the abrasive-binding agent composite slug of FIG. 11 from a bore rearward view, in accordance with the present disclosure.
Figure 13:
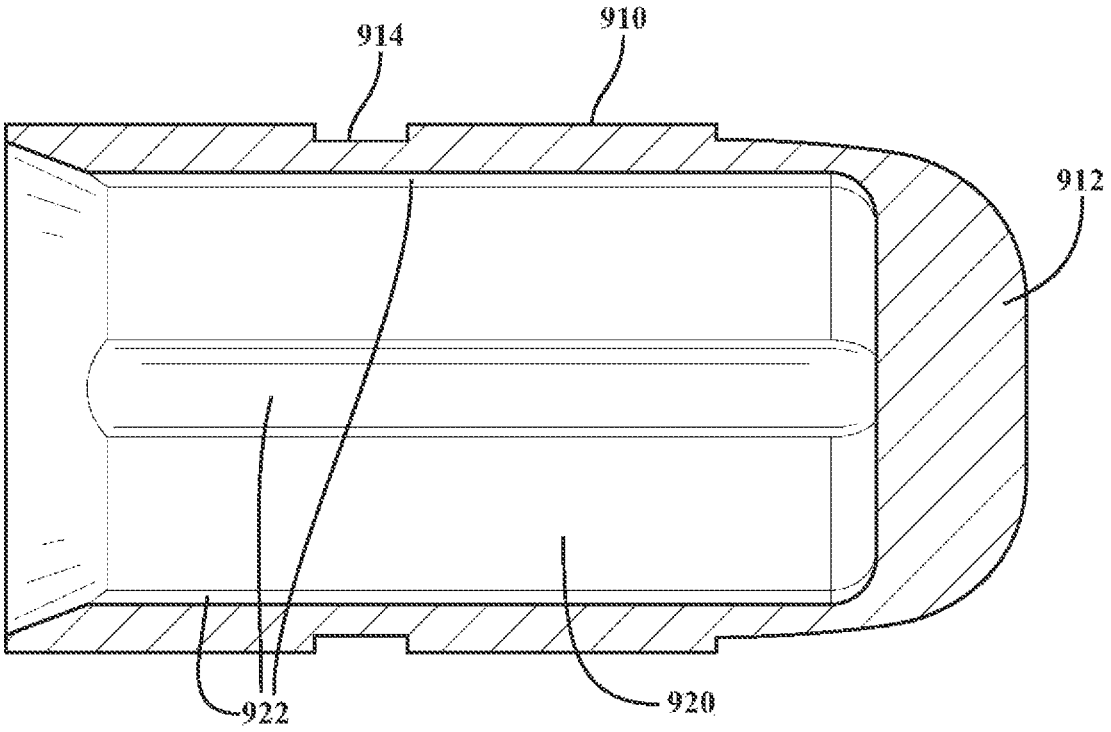
FIG. 13 schematically illustrates the abrasive-binding agent composite slug of FIG. 11 in a side sectional view, in accordance with the present disclosure.

FIG. 12 schematically illustrates the abrasive-binding agent composite slug of FIG. 11 from a bore rearward view. The abrasive-binding agent composite slug 910 is illustrated including the bore rearward recess 920. The bore rearward recess 920 includes four exemplary inner grooves 922. FIG. 13 schematically illustrates the abrasive-binding agent composite slug of FIG. 11 in a side sectional view. The abrasive-binding agent composite slug 910 is illustrated including the tapered bore forward tip 912 and the annular depressed groove 914. The bore rearward recess 920 is illustrated including a plurality of inner grooves 922.

Figure 14:
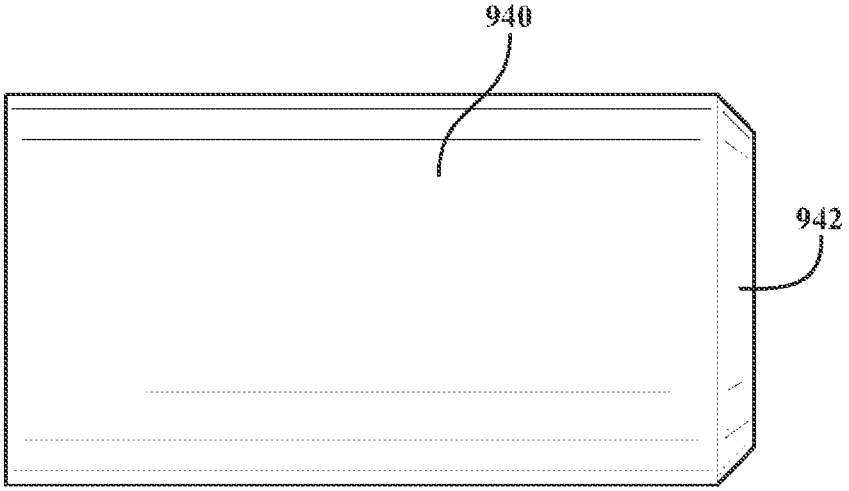
FIG. 14 schematically illustrates the high-density insert of FIG. 11 in a side view, in accordance with the present disclosure.

FIG. 14 schematically illustrates the insert of FIG. 11 in a side view. The high-density insert 940 is an embodiment of a high-density weight and includes the tapered tip 942 which may be useful to aid in inserting the high-density insert 940 into the bore rearward recess 920 of the abrasive-binding agent composite slug 910. The high-density insert 940 may be constructed with lead, steel, an alloy including multiple metals, a composite metallic structure, or other materials.

Figure 15:
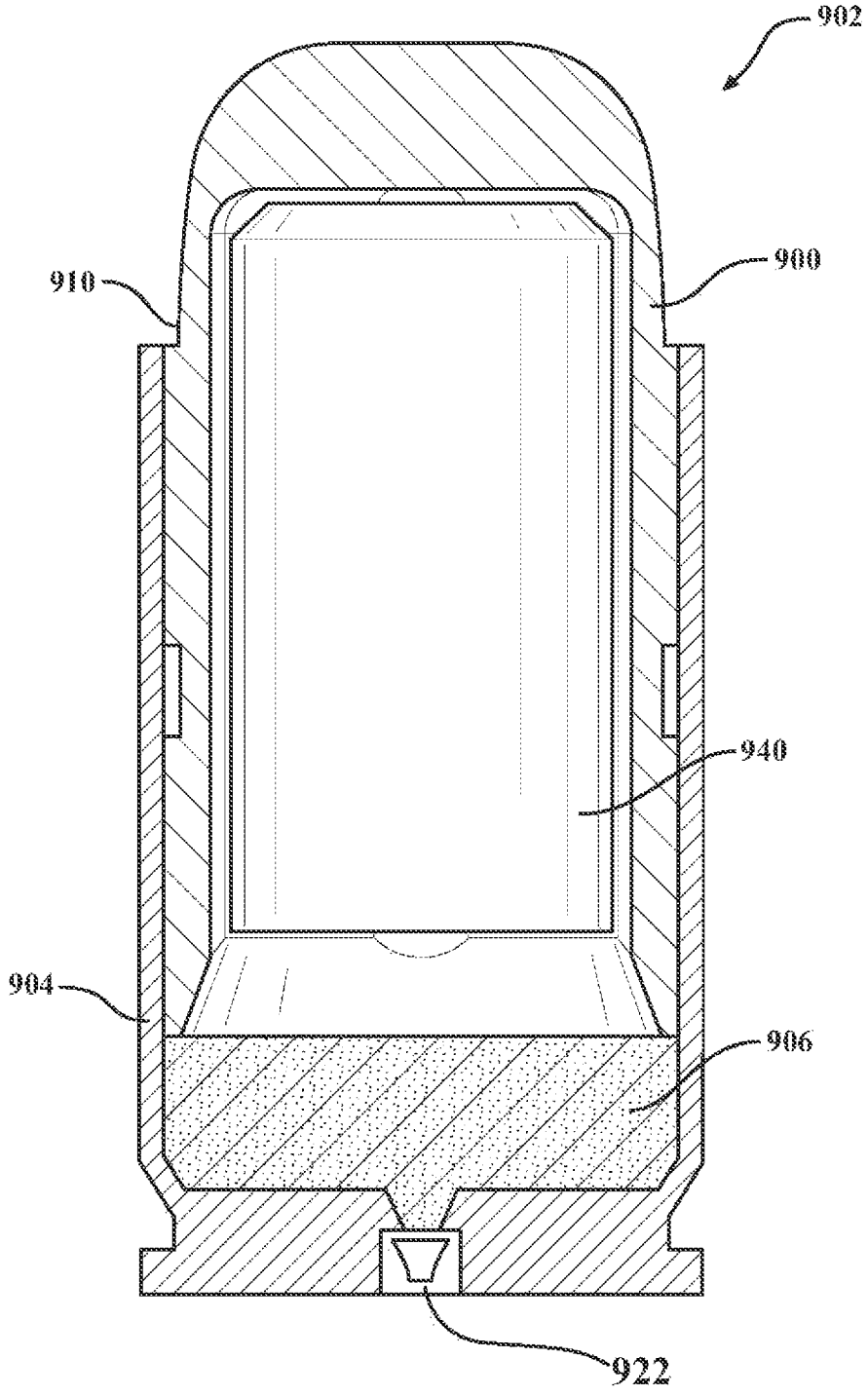
FIG. 15 schematically illustrates an exemplary ballistic barrel cleaning cartridge including the abrasive-binding agent composite slug and the high-density insert of FIG. 11, in accordance with the present disclosure.

FIG. 15 schematically illustrates an exemplary ballistic barrel cleaning cartridge including the abrasive-binding agent composite slug and the high-density insert of FIG. 11. A ballistic barrel cleaning cartridge 902 is illustrated, including casing 904, primer 922, propellant 906, and the two-piece slug assembly 900. Casing 904 may be made of brass, steel, or any other material in the art for ammunition casings. Casing 904 may include a primer 922 operable to create a spark when struck by a firing pin of a firearm. Casing 904 may be a centerfire casing or a rimfire casing. The two-piece slug assembly 900 includes the abrasive-binding agent composite slug 910 and the high-density insert 940. When the primer of the casing 904 creates a spark, the propellant 906 rapidly expands and applies pressure upon the two-piece slug assembly 900 which forces the two-piece slug assembly 900 down the bore of a firearm. The high-density insert 940 may include an outer diameter which permits the high-density insert 940 to easily be removed from the abrasive-binding agent composite slug 910. In another embodiment, the high-density insert 940 may include an outer diameter which is slightly larger than the inner diameter of the abrasive-binding agent composite slug 910, such that an interference fit is created between the parts.

Figure 16:
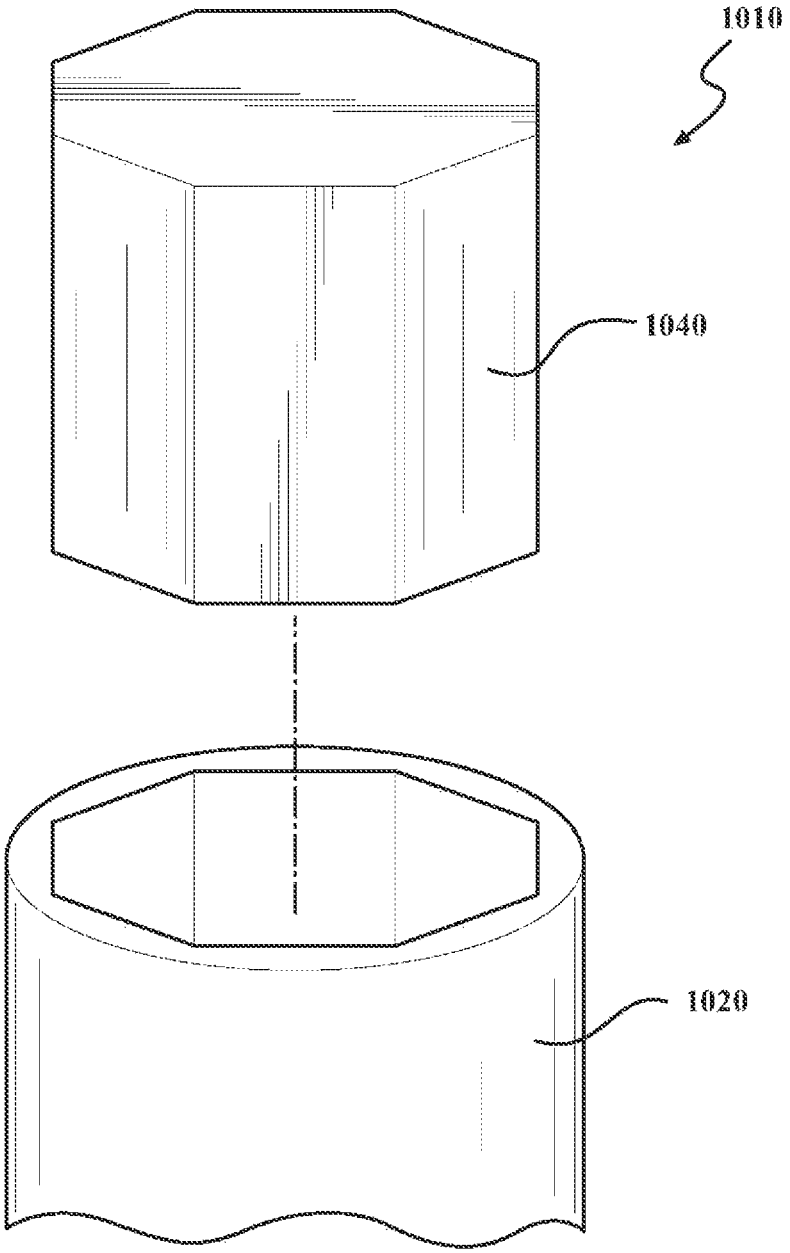
FIG. 16 schematically illustrates an alternative exemplary abrasive-binding agent composite slug with an octagonal cross section, in accordance with the present disclosure.

An abrasive-binding agent composite slug or a two-piece assembly including an abrasive-binding agent composite slug may be cylindrical in cross-section. Such a slug or assembly may alternatively have different cross-sectional shapes. FIG. 16 schematically illustrates an alternative exemplary abrasive-binding agent composite slug 1040 with an octagonal cross section. A configuration 1010 is illustrated including the abrasive-binding agent composite slug 1040 and a casing 1020 including a mating casing recess with the cross-sectional octagonal shape of the abrasive-binding agent composite slug 1040. A variety of cross-sectional shapes are envisioned, including square, triagonal, oval, and irregular shapes, and the disclosure is not intended to be limited to the examples provided herein.

Throughout the disclosure, a recess is intended to describe a feature upon a part or item. A recess may alternatively be described as an open end of an item, a walled-in enclosure with an open end, or a concave region of an item, or a feature or inner surface of an item operable to receive another item within the feature.

High-density weights described throughout the disclosure may be metallic. Exemplary metallic weights described in various embodiments may be replaced by non-metallic high density weights, such as with a stone or glass pellet.

While the best modes for carrying out the disclosure have been described in detail, those familiar with the art to which this disclosure relates will recognize various alternative designs and embodiments for practicing the disclosure within the scope of the appended claims.

The invention claimed is:

1. An apparatus comprising a ballistic barrel cleaning cartridge, comprising:

a casing including a casing recess, wherein the casing recess is closed at a first end of the casing;

a propellant disposed within the casing recess;

a relatively low-density abrasive-binding agent composite slug configured to be propelled down a bore of a firearm and constructed with an abrasive agent and a polymerized binding agent, wherein the abrasive-binding agent composite slug is disposed within the casing recess; and a relatively high-density bullet disposed within the casing recess at a second end of the casing; and wherein a ratio of a longitudinal length of the abrasive-binding agent composite slug to a diameter of the abrasive-binding agent composite slug is at least 0.75;

wherein the abrasive agent is operable to scrub the bore of the firearm;

wherein the abrasive-binding agent composite slug includes a cylindrical outer surface operable to seal against the casing recess;

wherein expansion of the propellant is operable to expel the abrasive-binding agent composite slug from the casing recess and propel the abrasive-binding agent composite slug down the bore of the firearm; and wherein the bullet is operable to provide back pressure upon the abrasive-binding agent composite slug as the abrasive-binding agent composite slug is propelled down the bore of the firearm.

2. The apparatus of claim 1, wherein the abrasive agent includes fiberglass.

3. The apparatus of claim 1, wherein the abrasive agent includes glass.

4. The apparatus of claim 3, wherein the polymerized binding agent includes nylon.

5. The apparatus of claim 3, wherein the polymerized binding agent includes one of acrylonitrile butadiene styrene, polypropylene, and polyethylene.

6. The apparatus of claim 1, wherein the bullet is exposed at a front portion of the ballistic barrel cleaning cartridge.

7. The ballistic barrel cleaning cartridge of claim 1, wherein the abrasive-binding agent composite slug includes a conical recess.

8. The ballistic barrel cleaning cartridge of claim 1, wherein a rear portion of the abrasive-binding agent composite slug is concave.

9. The apparatus of claim 1, wherein the abrasive agent is interspersed within the polymerized binding agent.

10. The apparatus of claim 1, wherein the ratio of a longitudinal length of the abrasive-binding agent composite slug to a diameter of the abrasive-binding agent composite slug is at least 0.89.

11. The apparatus of claim 1, wherein the ratio of a longitudinal length of the abrasive-binding agent composite slug to a diameter of the abrasive-binding agent composite slug is at least 1.09.

12. An apparatus comprising a ballistic barrel cleaning cartridge, comprising:

a casing including a casing recess, wherein the casing recess is closed at a first end of the casing;

a propellant disposed within the casing recess;

a relatively low-density abrasive-binding agent composite slug configured to be propelled down a bore of a firearm and constructed with an abrasive agent and a polymerized binding agent, wherein the abrasive-binding agent composite slug is disposed within the casing recess; and a relatively high-density bullet disposed within the casing recess at a second end of the casing; and wherein a first end of the abrasive-binding agent composite slug is disposed in contact with the bullet and wherein a second end of the abrasive-binding agent composite slug distal to the first end is disposed in contact with the propellant;

wherein the abrasive agent is operable to scrub the bore of the firearm;

wherein the abrasive-binding agent composite slug includes a cylindrical outer surface operable to seal against the casing recess;

wherein expansion of the propellant is operable to expel the abrasive-binding agent composite slug from the casing recess and propel the abrasive-binding agent composite slug down the bore of the firearm; and wherein the bullet is operable to provide back pressure upon the abrasive-binding agent composite slug as the abrasive-binding agent composite slug is propelled down the bore of the firearm.

13. The apparatus of claim 12, wherein the abrasive agent includes fiberglass.

14. The apparatus of claim 12, wherein the abrasive agent includes glass.

15. The apparatus of claim 14, wherein the polymerized binding agent includes nylon.

16. The apparatus of claim 14, wherein the polymerized binding agent includes one of acrylonitrile butadiene styrene, polypropylene, and polyethylene.

17. The apparatus of claim 12, wherein the bullet is exposed at a front portion of the ballistic barrel cleaning cartridge.

18. The apparatus of claim 12, wherein the abrasive agent is interspersed within the polymerized binding agent.

* * * * *